US007909586B2

(12) United States Patent
Yu et al.

(10) Patent No.: US 7,909,586 B2
(45) Date of Patent: Mar. 22, 2011

(54) FAN AND ROTOR THEREOF

(75) Inventors: Po-Hao Yu, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1118 days.

(21) Appl. No.: 11/363,368

(22) Filed: Feb. 28, 2006

(65) Prior Publication Data

US 2006/0280623 A1 Dec. 14, 2006

(30) Foreign Application Priority Data

Jun. 10, 2005 (TW) ..... 94119247 A

(51) Int. Cl.
*F04B 17/00* (2006.01)

(52) U.S. Cl. ..... 417/354; 417/353; 417/423.15; 416/204 R; 416/209; 416/234; 416/244 R

(58) Field of Classification Search ..... 417/353, 417/354, 423.15; 416/134, 132 R, 219 R, 416/234, 243 R, 243 AR, 244, 204 R, 209, 416/213 A, 174, 244 R
See application file for complete search history.

(56) References Cited

U.S. PATENT DOCUMENTS

| | | | | |
|---|---|---|---|---|
| 2,420,424 | A * | 5/1947 | Hackethal | 416/205 |
| 2,811,303 | A * | 10/1957 | Ault et al. | 416/223 R |
| 2,974,984 | A * | 3/1961 | Koch | 403/225 |
| 5,695,318 | A * | 12/1997 | Harmsen | 415/218.1 |
| 6,196,802 | B1 * | 3/2001 | Matsumoto | 416/229 R |
| 6,386,837 | B2 * | 5/2002 | Horng | 417/354 |
| 6,394,768 | B1 * | 5/2002 | Fukuda et al. | 417/423.15 |
| 6,612,814 | B2 * | 9/2003 | Shih et al. | 417/354 |
| 6,674,204 | B1 * | 1/2004 | Horng et al. | 310/156.12 |
| 6,893,230 | B2 * | 5/2005 | Sung et al. | 417/354 |
| 7,182,578 | B2 * | 2/2007 | Chou | 416/204 R |
| 7,548,007 | B2 * | 6/2009 | Chavez | 310/265 |
| 2002/0102158 | A1 * | 8/2002 | Otsuka | 415/199.4 |
| 2003/0210992 | A1 * | 11/2003 | Huang et al. | 417/366 |
| 2004/0136842 | A1 * | 7/2004 | Obara et al. | 417/354 |
| 2004/0253126 | A1 * | 12/2004 | Cheng | 417/423.1 |
| 2005/0111985 | A1 * | 5/2005 | Chen et al. | 416/204 R |

* cited by examiner

*Primary Examiner* — Devon C Kramer
*Assistant Examiner* — Leonard J Weinstein
(74) *Attorney, Agent, or Firm* — Birch, Stewart, Kolasch & Birch, LLP

(57) ABSTRACT

A fan includes a frame, a stator and a rotor. The stator is disposed in the frame, and the rotor is disposed in the frame and coupled with the stator. The rotor includes a connecting element, an impeller and a shaft. The connecting element has a flange. The impeller is disposed on a periphery of the connecting element. The flange is embedded with the impeller. One end of the shaft is connected to the connecting element and the impeller is rotated when the shaft rotates.

17 Claims, 4 Drawing Sheets

FAN AND ROTOR THEREOF

This non-provisional application claims priority under U.S.C.§119(A) on patent application No(s). 094119247, filed in Taiwan, Republic of China on Jun. 10, 2005, the entire contents of which are hereby incorporated by reference.

BACKGROUND OF THE INVENTION

1. Field of Invention

The present invention relates to a fan and a rotor thereof, and more particularly to a fan and a rotor thereof with high precision.

2. Related Art

Motors are widely used in various applications, such as a lathe, an electric drill and an electric saw in the industry, and a tape recorder, an optical drive, a hard disk drive, a pump, a blower, a dust cleaner, a refrigerator, a compressor of an air conditioner, and a fan in the daily life.

The fans are also widely used in dissipating heat generated from all electronic apparatuses, either the large industrial machines or the electronic products of the daily life, such as a power supply of a computer and an air conditioner.

As shown in FIG. 1, a conventional rotor 10 includes an impeller 11, an iron casing 12, a shaft 13 and a copper bushing 14. The impeller 11 is composed of a hub 111 and a plurality of blades 112. The copper bushing 14 is disposed at one end of the shaft 13. Conventionally, the copper bushing 14 is riveted to the iron casing 12, and then the protrusions 113 on the bottom of the hub 111 are respectively positioned in the openings 121 of the iron casing 12 correspondingly. The impeller 11 is connected to the iron casing 12 by way of hot melting or ultrasonic bonding. Thus, a complete rotor 10 is assembled.

However, the conventional rotor 10 has the following drawbacks.

First, when the impeller 11 is connected to the iron casing 12 by way of hot melting, the temperature rises so that the perpendicularity or the concentricity of the shaft 13 tends to be damaged due to different coefficients of thermal expansion of several different elements.

Second, when the impeller 11 is connected to the iron casing 12 by way of ultrasonic bonding, the perpendicularity or the concentricity of the shaft 13 tends to be damaged due to vibration caused by the ultrasonic bonding procedure.

Third, because of the multiple assemblies, in which the protrusion 113 on the bottom of the hub 111 has to be aligned with the opening 121 on the iron casing 12, another tolerance in addition to the original tolerance of the position of the opening 121 on the iron casing 12 is obtained due to the alignment and the bonding between the impeller 11 and the iron casing 12.

The damage to the perpendicularity or the concentricity of the shaft 13 and the accumulated tolerance tend to reduce production yield of the rotor 10, or even cause the skew and wear of the shaft 13. When the motor is rotating at the high speed, the problems caused by the skew and the wear tend to become more serious. It is thus imperative to provide a rotor structure, in which the perpendicularity or the concentricity of the shaft 13 is free from being influenced.

SUMMARY OF TH INVENTION

In view of the foregoing, the present invention provides a fan and a rotor thereof, in which the perpendicularity or the concentricity of a shaft is free from being influenced when an impeller of the rotor is assembled.

To achieve the above, a fan according to the present invention includes a frame, a stator and a rotor. The stator is disposed in the frame. The rotor is disposed in the frame and coupled with the stator. The rotor includes a connecting element, an impeller and a shaft. The connecting element has a flange. The impeller is disposed on a periphery of the connecting element and is embedded with the flange of the connecting element, and one end of the shaft is connected to the connecting element.

To achieve the above, a rotor according to the present invention includes a connecting element, an impeller and a shaft. The connecting element has a flange. The impeller is disposed on a periphery of the connecting element and is embedded with the flange of the connecting element, and one end of the shaft is connected to the connecting element.

As mentioned above, due to the impeller is formed on the connecting element by way of injection molding, a fan and a rotor thereof according to the present invention are unnecessary to connect the impeller and the motor housing through cooperating the protrusions on the impeller with the openings on the motor housing, and then connecting by way of hot melting or ultrasonic bonding in the prior art. Consequently, the present invention can prevent the damage to the perpendicularity or the concentricity of the shaft caused by the hot melting process or the ultrasonic bonding process. In addition, because of skipping the cooperation between the protrusion of the impeller and the opening of the motor housing, the tolerance caused by the multiple assemblies may be reduced, and thus the precision of the fan and the rotor is improved. Furthermore, because the connecting element has the flange to be embedded with the impeller, the position of the impeller may be secured without shift during the high-speed rotation.

BRIEF DESCRIPTION OF THE DRAWINGS

The present invention will become more fully understood from the detailed description given herein below illustration only, and thus are not limitative of the present invention, and wherein.

DETAILED DESCRIPTION OF THE INVENTION

A fan and a rotor thereof according to the preferred embodiment of the present invention will be apparent from the following detailed description, which proceeds with reference to the accompanying drawings, wherein the same references relate to the same elements.

Figure 1:
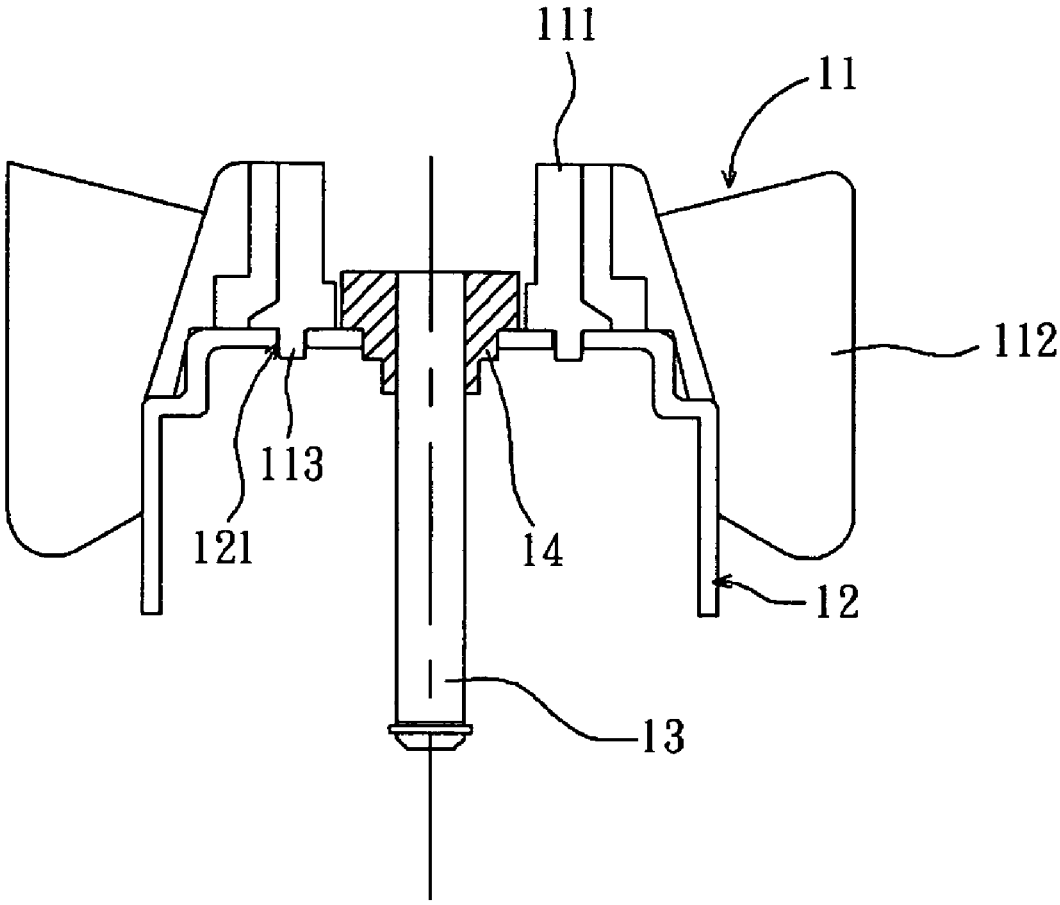
FIG. 1 (PRIOR ART)
FIG. 1 is a schematic view showing the structure of a conventional rotor.
Figure 2:
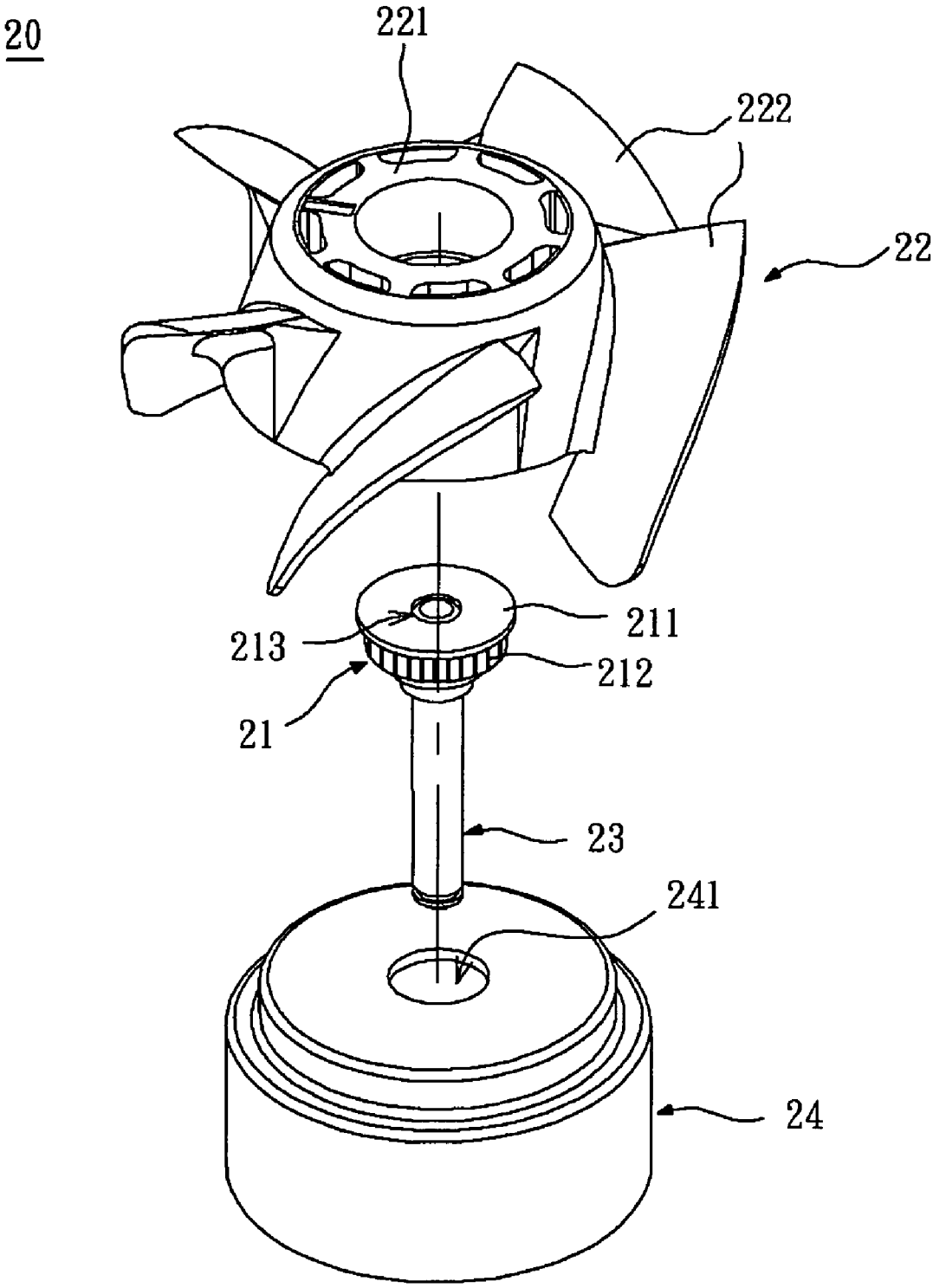
FIG. 2 is a schematic view showing a rotor according to a preferred embodiment of the present invention.
Figure 3:
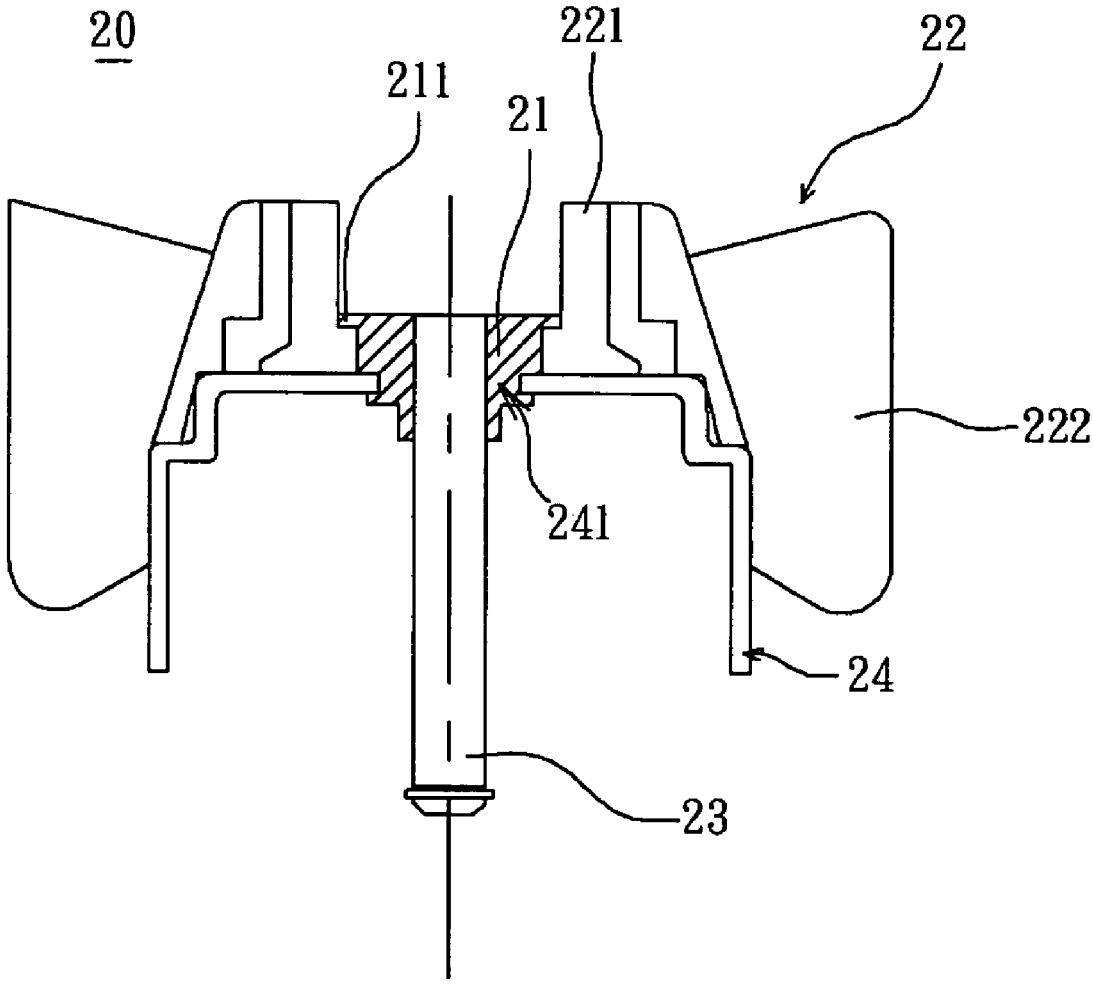
FIG. 3 is another schematic view showing the rotor according to the preferred embodiment of the present invention.

Referring both to FIGS. 2 and 3, FIG. 2 is a schematic view showing a rotor according to a preferred embodiment of the present invention, and FIG. 3 is another schematic view showing the rotor according to the preferred embodiment of the present invention. A rotor 20 includes a connecting element 21, an impeller 22 and a shaft 23.

The connecting element 21 has a flange 211. In this embodiment, the connecting element 21 is a preferred bushing and is made of a metallic material such as copper. As shown in FIG. 2, the connecting element 21 may further have a plurality of textures 212 arranged in parallel with the shaft 23 and disposed around the connecting element 21. When the connecting element 21 is connected to the impeller 22, the textures 212 enlarge the contact area between the connecting element 21 and the impeller 22 so as to intensify the connecting force between the connecting element 21 and the impeller 22. Consequently, the impeller 22 cannot be easily separated from the connecting element 21 during the high-speed rotation of the impeller 22.

As shown in FIG. 3, the impeller 22 is disposed around a periphery of the connecting element 21 by way of, for example, injection molding. That is, when the injection molding process is performed, the connecting element 21 is placed into a mold, and the plastic material flows into the mold and contacts with the connecting element 21 to form the impeller 22 on the connecting element 21.

The flange 211 of the connecting element 21 is embedded with the impeller 22. In this embodiment, the impeller 22 includes a hub 221 and a plurality of blades 222 disposed around the hub 221. The flange 211 of the connecting element 21 is embedded with the hub 221 of the impeller 22. When the rotor 20 is rotating, the impeller 22 can be firmly connected to the connecting element 21 because the flange 211 is embedded with the hub 221. Especially when the rotor 20 is rotating at high speed, the flange 211 is needed to secure the impeller 22 and prevents the impeller 22 from shifting during the high-speed rotation of the rotor 20.

One end of the shaft 23 is connected to the connecting element 21. In this embodiment, the shaft 23 may be a motor shaft, and the connecting element 21 has a hole 213 for allowing the shaft 23 to penetrate therethrough, such that the connecting element 21 is disposed at one end of the shaft 23.

As shown in FIG. 3, the rotor 20 may further include a motor housing 24 connected to the shaft 23. In this embodiment, the motor housing 24 has an opening 241 for allowing the shaft 23 to penetrate therethrough, such that the motor housing 24 is adjacent to the connecting element 21.

Because the impeller 22 of the rotor 20 may be directly formed on the connecting element 21 by way of injection molding, the present invention is unnecessary to connect the impeller 22 and the motor housing 24 through cooperating the protrusions on the impeller 22 with the openings on the motor housing 24, and then connecting by way of hot melting or ultrasonic bonding in the prior art. Consequently, the present invention can prevent the damage to the perpendicularity or the concentricity of the shaft 23 caused by the hot melting process or the ultrasonic bonding process. In addition, because of skipping the cooperation between the protrusions of the impeller 22 and the openings of the motor housing 24, the tolerance caused by the multiple assemblies is reduced, and thus the precision of the rotor 20 is improved.

Figure 4:
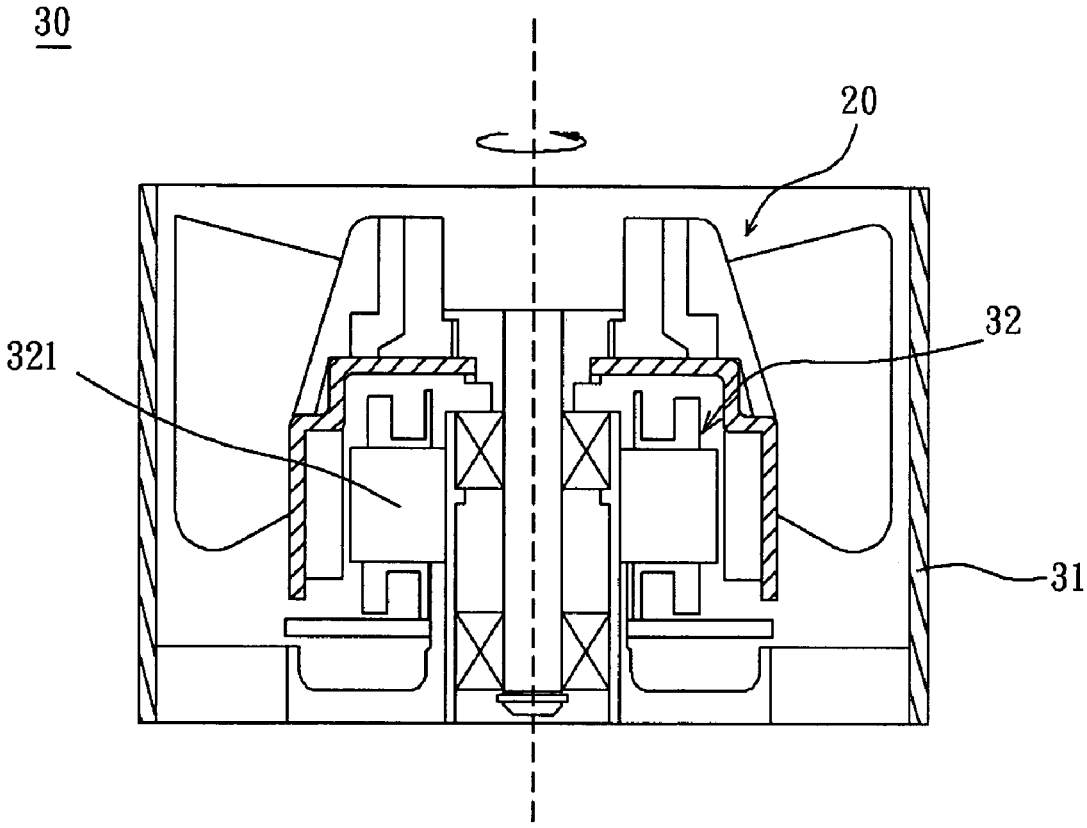
FIG. 4 is a schematic view showing a fan according to a preferred embodiment of the present invention.

The fan according to the preferred embodiment of the present invention will be described with reference to FIGS. 2 to 4. FIG. 4 is a schematic view showing a fan according to a preferred embodiment of the present invention.

As shown in FIGS. 2 to 4, a fan 30 includes a frame 31, a stator 32 and a rotor 20. The stator 32 is disposed in the frame 31. In this embodiment, the stator 32 has a plurality of coils 321. The rotor 20 is disposed in the frame 31 and coupled with the stator 32. The current is flowing into the coils 321 for driving the rotor 20 to rotate relatively to the stator 32.

As shown in FIG. 2, the rotor 20 includes a connecting element 21, an impeller 22 and a shaft 23. The connecting element 21 has a flange 211. In this embodiment, the connecting element 21 may be a bushing and be made of a metallic material such as copper. The connecting element 21 may further have a plurality of textures 212 disposed around the connecting element 21. The textures 212 are connected to the impeller 22. The textures 212 may be arranged in a direction of being slant, parallel or perpendicular to the shaft 23. The textures 212 can enlarge the contact area between the connecting element 21 and the impeller 22 so as to intensify the connecting force between the connecting element 21 and the impeller 22. Consequently, the impeller 22 cannot be easily separated from the connecting element 21 during the high-speed rotation of the impeller 22.

As shown in FIG. 3, the impeller 22 is disposed around a periphery of the connecting element 21 by way of, for example, injection molding. That is, when the injection molding process is performed, the connecting element 21 is placed into a mold, and the plastic material flows into the mold and contacts with the connecting element 21 to form the impeller 22 on the connecting element 21.

The flange 211 of the connecting element 21 is embedded with the impeller 22. In this embodiment, the impeller 22 includes a hub 221 and a plurality of blades 222 disposed around the hub 221. The flange 211 of the connecting element 21 is embedded with the hub 221 of the impeller 22. When the rotor 20 is rotating, the impeller 22 can be firmly connected to the connecting element 21 because the flange 211 is embedded with the hub 221. Especially, when the rotor 20 is rotating at the high speed, the flange 211 is needed to secure the impeller 22 and prevents the impeller 22 from shifting during the high-speed rotation of the rotor 20.

One end of the shaft 23 is connected to the connecting element 21. In this embodiment, the shaft 23 may be a motor shaft, and the connecting element 21 has a hole 213. The shaft 23 penetrates through the hole 213 of the connecting element 21 such that the connecting element 21 is disposed at one end of the shaft 23.

As shown in FIG. 3, the rotor 20 may further include a motor housing 24 connected to the shaft 23. In this embodiment, the motor housing 24 has an opening 241 for allowing the shaft 23 to penetrate therethrough, such that the motor housing 24 is adjacent to the connecting element 21.

In summary, due to the impeller is formed with the connecting element by way of injection molding, a fan and a rotor thereof according to the present invention are unnecessary to connect the impeller to the motor housing through cooperating the protrusions on the impeller with the openings on the motor housing, and then connecting by way of hot melting or ultrasonic bonding in the prior art. Consequently, the present invention can prevent the damage to the perpendicularity or the concentricity of the shaft caused by the hot melting process or the ultrasonic bonding process. In addition, because of skipping the cooperation between the protrusions of the impeller and the openings of the motor housing, the tolerance caused by the multiple assemblies is reduced, and thus the precision of the fan and the rotor is improved. Furthermore, because the connecting element has the flange to be embedded with the impeller, the position of the impeller may be secured without shift during the high-speed rotation.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A rotor, comprising:

a connecting element having a flange;

an impeller having a hub wherein the impeller is molded on a periphery of the connecting element so that the flange of the connecting element is embedded with the hub of the impeller;

a shaft having one end connected to the connecting element, wherein the impeller is rotated when the shaft rotates, and the impeller is not in contact with the shaft; and a motor housing connected to the shaft by the connecting element, wherein the motor housing is separate from the impeller while being connected to the shaft through the connecting element such that the motor housing does not contact the shaft.

2. The rotor according to claim 1, wherein the impeller further comprises a plurality of blades disposed around the hub.

3. The rotor according to claim 1, wherein the connecting element has a plurality of textures disposed around the connecting element such that the connecting element is connected to the impeller via the textures.

4. The rotor according to claim 3, wherein the impeller further comprises a plurality of blades disposed around the hub, and the textures of the connecting element are connected to the hub.

5. The rotor according to claim 1, wherein the connecting element has a hole for allowing the shaft to penetrate therethrough.

6. The rotor according to claim 1, wherein the connecting element comprises a metallic material.

7. The rotor according to claim 1, wherein the impeller is formed on the periphery of the connecting element as a single unit by way of injection molding.

8. The rotor according to claim 1, wherein the motor housing has an opening, and the shaft penetrates through the opening such that the motor housing is adjacent to the connecting element.

9. A fan, comprising:

a frame;

a stator disposed in the frame;

a rotor disposed in the frame and coupled with the stator, and the rotor comprising a connecting element, an impeller and a shaft, wherein the connecting element has a flange, the impeller has a hub and is molded on a periphery of the connecting element without contacting the shaft so that the flange of the connecting element is embedded with the hub of the impeller, one end of the shaft is connected to the connecting element, and the impeller is rotated when the shaft rotates; and a motor housing connected to the shaft by the connecting element, wherein the motor housing is separate from the impeller while being connected to the shaft through the connecting element such that the motor housing does not contact the shaft.

10. The fan according to claim 9, wherein the impeller further comprises a hub and a plurality of blades disposed around the hub.

11. The fan according to claim 9, wherein the connecting element has a plurality of textures disposed around the connecting element such that the connecting element is connected to the impeller via the textures.

12. The fan according to claim 11, wherein the impeller further comprises a plurality of blades disposed around the hub, and the textures of the connecting element are connected to the hub.

13. The fan according to claim 9, wherein the connecting element has a hole for allowing the shaft to penetrate therethrough.

14. The fan according to claim 9, wherein the connecting element comprises a metallic material.

15. The fan according to claim 9, wherein the impeller is formed on the periphery of the connecting element as a single unit by way of injection molding.

16. The fan according to claim 9, wherein the motor housing has an opening for allowing the shaft to penetrate therethrough such that the motor housing is adjacent to the connecting element.

17. A rotor, comprising:

a connecting element having a plurality of textures on a periphery thereof;

the connecting element haying a flange, an impeller molded on a periphery of the connecting element via the textures, wherein the impeller comprises a hub and the flange of the connecting element is embedded with the hub;

a shaft having one end connected to the connecting element, wherein the impeller is rotated when the shaft rotates, and the impeller is not in contact with the shaft; and a motor housing connected to the shaft by the connecting element, wherein the motor housing is separate from the impeller while being connected to the shaft through the connecting element such that the motor housing does not contact the shaft.

* * * * *